US005269240A

United States Patent [19]

Holl et al.

[11] Patent Number: 5,269,240

[45] Date of Patent: Dec. 14, 1993

[54] OVERCAST SEWING MACHINE FOR FORMING A MULTIPLE-THREAD OVERCAST SEAM

[75] Inventors: Helmar Holl; Günter Meier, both of Karlsruhe, Fed. Rep. of Germany

[73] Assignee: Pfaff Haushlatmaschinen GmbH, Karlsruhe, Fed. Rep. of Germany

[21] Appl. No.: 635,107

[22] PCT Filed: Jun. 1, 1989

[86] PCT No.: PCT/EP89/00616

§ 371 Date: Feb. 6, 1991

§ 102(e) Date: Feb. 6, 1991

[87] PCT Pub. No.: WO90/00640

PCT Pub. Date: Jan. 25, 1990

[30] Foreign Application Priority Data

Jul. 16, 1988 [DE] Fed. Rep. of Germany ..... 3824152
Mar. 15, 1989 [DE] Fed. Rep. of Germany ..... 3908388

[51] Int. Cl.[5] ..... D05B 1/20; D05B 57/06

[52] U.S. Cl. ..... 112/162; 112/168; 112/199

[58] Field of Search ..... 112/160, 162, 163, 166, 112/167, 168, 159, 177, 199, 268

[56] References Cited

U.S. PATENT DOCUMENTS 3,610,187 10/1971 Fukutomi ..... 112/162
4,237,804 12/1980 Hirayama ..... 112/168
4,546,715 10/1985 Mori ..... 112/162
4,641,592 2/1987 Marchesi ..... 112/162
4,799,439 1/1989 Koshinaka et al. ..... 112/168 X
4,970,976 11/1990 Kitai et al. ..... 112/162

FOREIGN PATENT DOCUMENTS 3639390 7/1987 Fed. Rep. of Germany .
4000747 2/1991 Fed. Rep. of Germany ..... 112/162
0129079 7/1985 Japan ..... 112/162
2162552 2/1986 United Kingdom ..... 112/162

*Primary Examiner*—Clifford D. Crowder
*Assistant Examiner*—Ismael Izaguirre
*Attorney, Agent, or Firm*—McGlew and Tuttle

[57] ABSTRACT

An overcast sewing machine in which a plurality of different stitch types can be sewn.

Various designs are disclosed for sewing alternatingly the stitch types 512 and 514, which consist of two needle threads, one lower looper thread and one overcast looper thread. In one design, the holder of the overcast looper can be fixed in a first working position, in which both needle threads are interlinked with the overcast looper thread, and can be displaced into a second working position, in which only one needle thread is interlinked with the overcast looper thread. According to another design, two thread eyes are provided in the overcast looper and the overcast looper thread is threaded through one of these thread eyes to form one of the stitch types and through the other thread eye to form the other stitch type. In addition, stitch type 504, consisting of three threads, can be formed by removing one needle. To form a stitch type 502 consisting of one needle thread and one lower looper thread, an overcast looper with a fork-shaped catching tip can be moved on the looper holder from a resting position into a working position, in which the lower looper thread is laid around the edge of the material being sewn and is fed to the needle for penetration.

The stitch-forming devices mentioned above are associated with additional stitchforming devices for forming a double chain stitch seam stitch type 401, DIN 61400, U.S. Federal Standard Catalogue Number 751.

11 Claims, 6 Drawing Sheets

Fig. 13
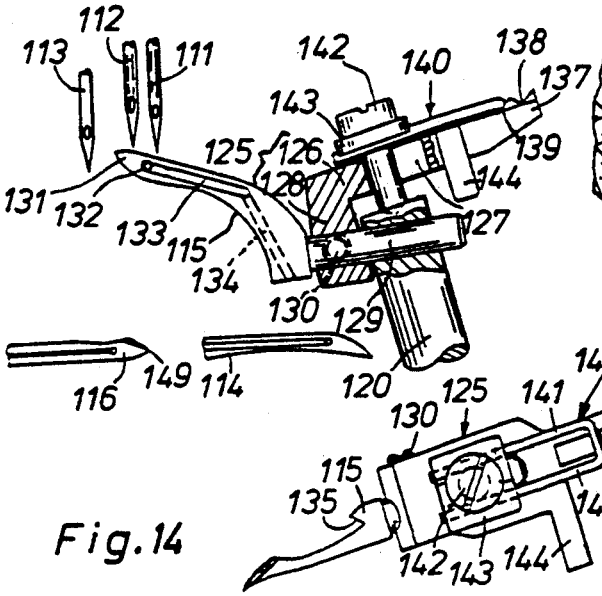
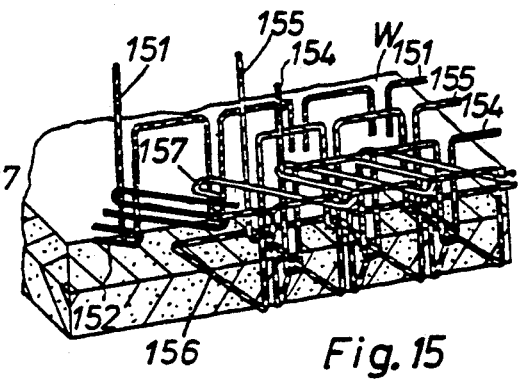
Fig. 15
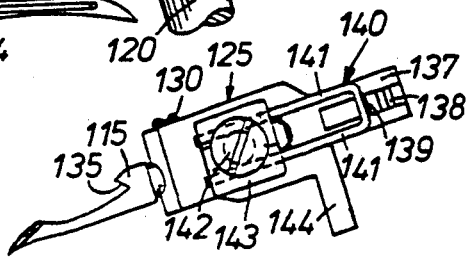
Fig. 14
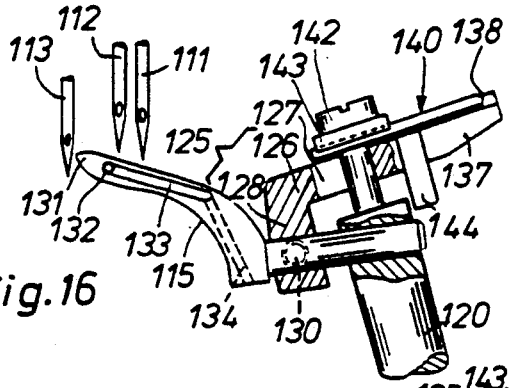
Fig. 16
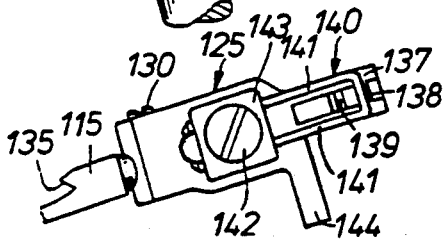
Fig. 17
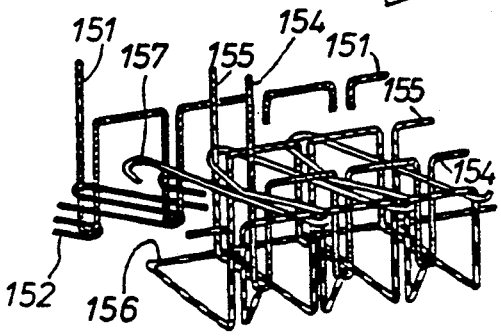
Fig. 18

Fig. 19
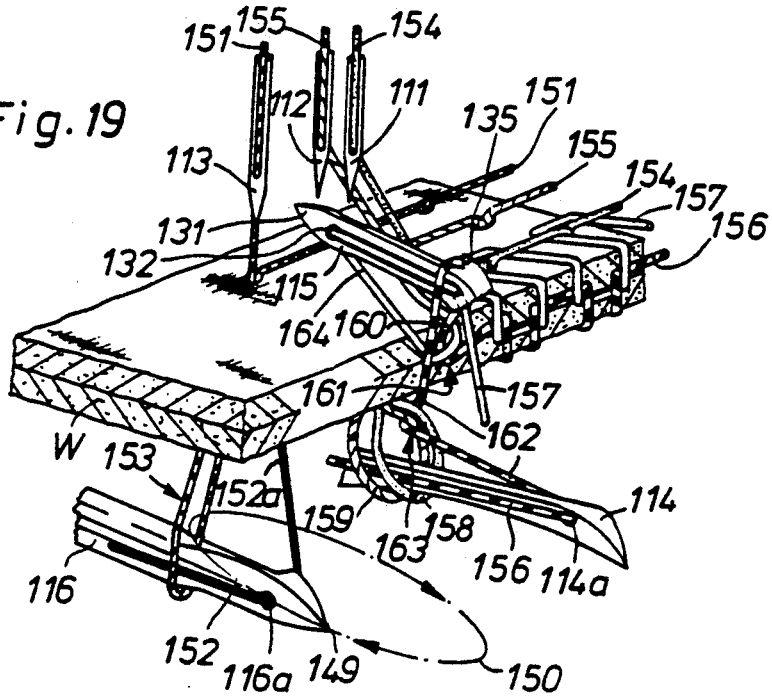
Fig. 20
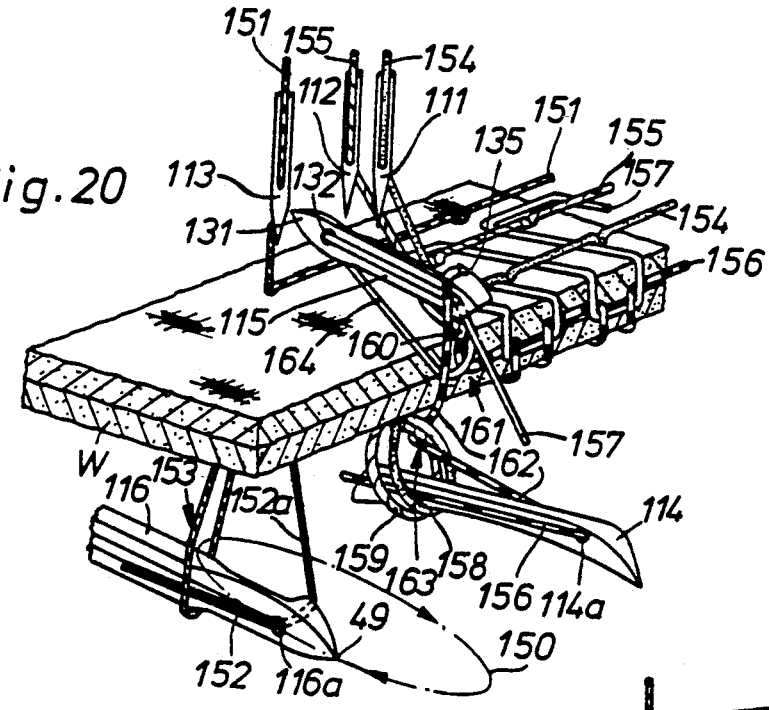
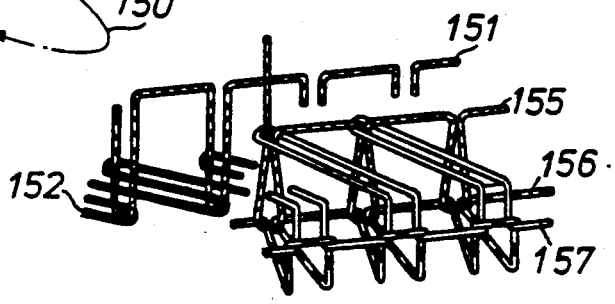
Fig. 21

OVERCAST SEWING MACHINE FOR FORMING A MULTIPLE-THREAD OVERCAST SEAM

BACKGROUND OF THE INVENTION

1. Field of the Invention

The present invention pertains to an overcast sewing machine for forming multiple-thread overcast seams, the sewing machine including at least two thread-carrying needles arranged at spaced locations from each other, one thread carrying lower looper taking up and throwing off the needle thread loops, and one thread-carrying overcast looper arranged on a looper holder for taking up the looper thread carried by the needle thread loops and laying the overcast looper thread around the edge of the material being sewn and feeding it for inserting the needles into a triangle formed by the leg of the overcast looper thread extending from the thread eye to the interlacing of the lower looper thread with the overcast looper thread at the edge of the material being sewed, by the needle-side leg of the lower looper thread line around the overcast looper, and by the overcast looper and, to an improvement of the design according to West German Offenlegungsschrift No., DE-OS 36, 39, 390.

2. Background Art

The West German Offenlegungsschrift No., DE-OS 36, 39,390 discloses an overcast sewing machine with at least three thread-carrying needles, which are arranged next to each other, are aligned in a straight direction at right angles to the direction of feed of the material to be sewn and are arranged in a needle holder from which one needle or more needles can be removed. The sewing machine includes a thread-carrying lower looper, which cooperates with all needles; and an overcast looper, to which a limited pivoting movement is imparted, and which cooperates with all the needles except for the needle located farthest away from the edge of the material to be sewn.

This overcast sewing machine forms an overcast stitch type not covered by either U.S. Federal Standard Catalogue No. 751 or German DIN Specification No. 61400, which consists of at least five threads, including three needle threads, which penetrate the material being sewn during sewing and are subdivided, depending on the distance from the edge of the material being sewn, into first needle threads and one last needle thread, as well as one lower looper thread and one overcast looper thread, which are interlaced at the edge of the material being sewn and are interlinked with all needle threads in the material being sewn. The overcast looper thread extends between the lower looper thread, with which it is interlinked at the edge of the material being sewn, and the first needle threads, which extend in parallel to the edge of the material being sewn and next to each other at spaced locations, and all of them are interlinked with the overcast looper thread. However, the last needle thread is interlinked only with the lower looper thread.

By inserting another thread-carrying needle in the needle holder, it is possible to make a stitch type consisting of six threads, namely, four needle threads, one lower looper thread, and one overcast looper thread, in which stitch type the needle thread located farthest away from the edge of the material being sewn is interlinked only with the lower looper thread, and all others are interlinked with the lower looper thread and the overcast looper thread.

If sewing is performed with only two thread-carrying needles, stitch type 514 is formed, which consists of two needle threads, one lower looper thread, and one overcast looper thread, and the latter is interlinked with both needle threads in the fabric being sewn and is interlaced with the lower looper thread at the edge of the material being sewn.

To form stitch type 504, which consists of one needle thread, one lower looper thread, and one overcast looper thread, which are interlaced with each other at the edge of the material being sewn and are interlinked with the needle thread in the material being sewn, the second needle must be removed.

If, among the three thread-carrying needles, the needle located farthest away from the edge of the material being sewn is retained, and the first or second needle is optionally removed, it is possible to form stitch type 512, in which the needle thread located farthest away from the edge of the material being sewn is interlinked only with the lower looper thread in the material being sewn, while the lower looper thread and the overcast looper thread are interlinked with the other needle thread in the material being sewn, and the latter threads are interlaced with each other at the edge of the material being sewn.

The changeover from one stitch type to another is consequently carried out by adding or removing certain needles. Even though it is thus possible to make several stitch types on one sewing machine, when adding one or several needles, it is necessary to rethread the needle thread, usually through a number of thread guide eyes and the eye of the needle, which is relatively time-consuming, in addition to insertion into the needle holder and fixing.

SUMMARY AND OBJECT OF THE INVENTION

It is primary object of the present invention to design an overcast sewing machine of this class such that several stitch types can be sewn with minimum effort for changeover.

According to the present invention, various designs are provided to accomplish this task. The design according to the invention including providing a shutter looper which may be fixed in a first working position, in which both needles penetrate into the above mentioned triangle, and can be displaced into and fixed in a second working position, in which only one needle, adjacent to the edge of the material being sewn penetrates into the triangle, makes it unnecessary to reroute the threading or to rethread the thread if the stitch types 512 and 514 are sewn alternatingly. To achieve this, the overcast looper only needs to be brought from one working position into another.

Stitch type 504 can also be prepared, as in the state of the art, by removing one of the needles.

Advantageous designs of the overcast looper, its holder and its guide bar are provided in which the overcast looper includes a shaft which is arranged displaceable in a transverse hole of a guide bar and is fastened to the looper holder, which is arranged at a free end of the guide bar such that it can be displaced between the first and second working positions and can be fixed there.

The design including two locking grooves for receiving a spring clip which is fastened on the guide bar, provided on the looper holder ensures reliable fixation of the overcast looper in both working positions in a simple manner.

The measure of the invention including providing the looper holder with a hand grip, facilitates handling during the changeover from one stitch type to the other.

The design according to the invention in which the overcast looper has two thread eyes, located at spaced locations at a distance corresponding to the distance between the needles, through which thread eyes the thread carried by the overcast looper can be lead optionally to form two different overcasts seams, so that one needle penetrates into the above mentioned triangle when the overcast looper thread is lead through one thread eye and both needles penetrate into the triangle when the overcast looper thread is lead through the other thread eye, requires only transferring the overcast looper thread from one thread guide eye into the other in order to sew the stitch types 512 and 514 alternatingly.

The measures according to the invention in which the overcast looper is overlaid by a looper with a fork shaped catching tip formed by two legs of unequal length such that the leg of the looper farther away from the needle supplements the tip of the overcast looper and the looper can be displaced on the looper holder from a shut-off position into a working position and can be fixed there, in which working position it catches, together with the tip of the overcast looper, the lower looper thread, lays it around the edge of the material being sewed and feeds it to the point of insertion of the needle between the overcast looper and its leg extending from the bottom of the fork to the edge of the material being sewed, expands the field of use of the overcast sewing machine by the possibility of sewing stitch type 502.

The design according to the invention in which the fork shaped looper has an angularly bent end with an essentially rectangular opening, through which a projection of the looper holder extends to secure the position, serves to secure the position of the overcast looper with the fork-shaped catching tip and the design according to the invention in which the fork-shaped looper has a hand grip, serves to facilitate the changeover of this looper when changing over from the resting position to the working position and vice versa.

The characteristics of an overcast sewing machine as described so far make it possible to change over a sewing machine for forming a plurality of different overcast stitch types. As a result, a number of users, especially small entities and the household, can do without purchasing several special machines, which are designed to form only one or two overcast stitch types, and which are consequently suitable only for special types of fabric and for corresponding stitch type requirements. All overcast stitch types share the common feature that they can be used in a time-saving and highly efficient manner to sew together two fabric layers while hemming in or cleaning and securing the fabric edges against fraying, and seams prepared with these stitch types are characterized by high longitudinal extensibility. In contrast, the tensile strength of the seam and the stability under higher stresses are not very good compared with seams prepared with other stitch types.

Under the type designation "Hobbylock 795", the applicant markets an overcast sewing machine published in Pfaff Company's Booklet "Für's Atelier", Document No. 23369 3.87 (Kala), which has stitch-forming devices for forming an overcast seam of stitch type 503 according to DIN 61400, U.S. Federal Standard Catalogue No. 751, in combination with stitch-forming devices for forming a double chain stitch seam, stitch type 401 according to 61400, U.S. Federal Standard Catalogue No. 751, at a laterally spaced location from the overcast seam. The combination of the overcast seam with the double chain stitch seam unites high longitudinal extensibility with high tensile strength of the seam. However, for processing knitted goods, the overcast seam of stitch type 503 is too narrow to sufficiently secure the edges of the fabric layers.

The measure according to the invention in which the stitch-forming means performing the respective overcast seam (stitch types numbers 504, 512, 514, DIN61400, U.S. Federal Standard Catalogue Number 751) are associated with additional stitch-forming means performing a double chain stitch seam (stitch type number 401, DIN61400, U.S. Federal Standard Catalogue Number 751) to the side of the overcast seam (stitch types numbers 504, 512, 514,), is suggested to expand the possible applications of such a sewing machine. To achieve higher strength of the connection and higher resistance to stresses, each overcast seam to be formed with the means according to the intention specified in the paragraphs above is supplemented with a double chain stitch seam of stitch type 401, so that the existing possibilities for forming different stitch types are expanded.

Because of the extremely limited space available under the needle plate, it is advantageous to arrange the additional stitch-forming devices, according to the invention such that the additional stitch forming means are arranged in front of the stitch forming means performing the overcast seams (stitch type numbers, 504, 512, 514).

The measures according to the invention in which the stitch forming tools performing:

(A) A thread overcast seam stitch type number, 504, DIN61400, U.S. Federal Standard Catalogue Number 751;

(B) An imitation four-thread overcast safety seam, stitch type number, 512, DIN61400 U.S. Federal Standard Catalogue Number 751; and (C) A four-thread overcast seam, stitch type number, 514, DIN61400, U.S. Federal Standard Catalogue Number 751, are always activated in combination with the stitch forming means for forming the double chain stitch seam, stitch type number, 401 which also can be used alone or activated alone, ensures versatile possibilities of application for a single sewing machine. As a result, the machine can be used for nearly all the sewing-together and hemming-in operations that occur in practice.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 13 is a partially sectional view showing an enlarged detail of the guide bar with the overcast looper fastened in a holder and the partially represented lower looper in a position for forming the stitch types 401 and 512, DIN 61400, U.S. Federal Standard Catalogue No. 751, which are shown in FIG. 15;

FIG. 14 is a top view of the arrangement according to FIG. 13;

FIG. 15 is a schematic representation of stitch types 401 and 512;

FIG. 16 is a representation similar to FIG. 13 in a position for forming the stitch types 401 and 514, DIN 61400, U.S. Federal Standard Catalogue No. 751, which are shown in FIG. 18, FIG. 17 is a top view of the arrangement according to FIG. 16;

FIG. 18 is a schematic representation of stitch types 401 and 514;

FIG. 19 is a perspective view illustrating the formation of stitch types 401 and 512, FIG. 20 is a perspective view illustrating the formation of stitch types 401 and 514, and FIG. 21 is a schematic representation of stitch type 504 together with stitch type 401.

DETAILED DESCRIPTION OF PREFERRED EMBODIMENT

Figure 1:
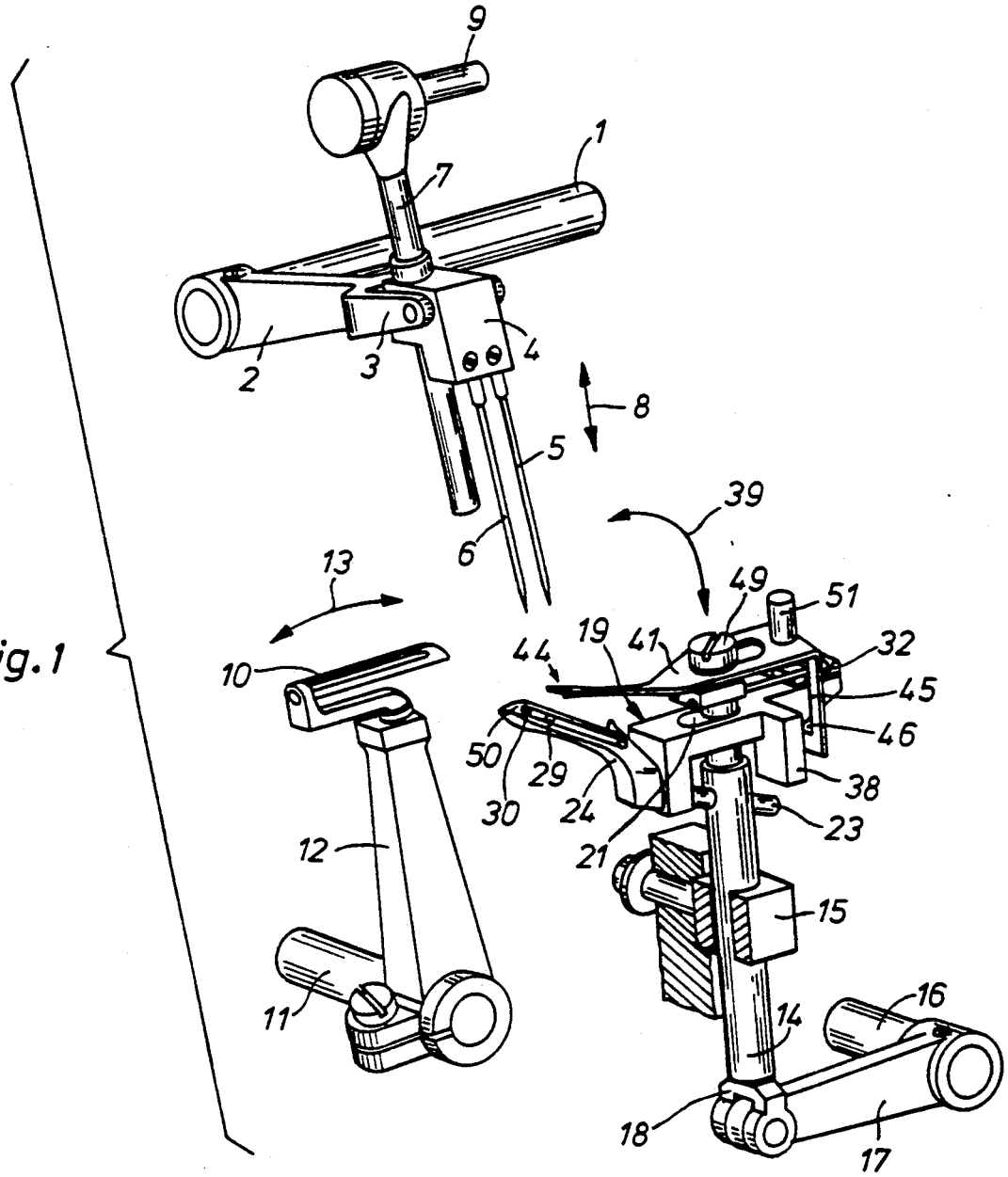
FIG. 1 is an exploded partially sectional view showing the needles and loopers participating in stitch formation with parts of their drive mechanisms.

As is shown in FIG. 1, the needle drive lever 2, whose fork-shaped end 3 is hinged to the needle holder 4, in which two thread-carrying needles 5 and 6 are fastened interchangeably, is fastened on the oscillating shaft 1. The needle holder 4 is guided longitudinally movably on a sliding bar 7 corresponding to arrow 8, and the sliding bar is mounted on a pin 9 that is a permanent part of the housing. A thread-carrying lower looper 10, which is fastened in a looper holder 12 clamped on the oscillating shaft 11, cooperates with the needles 5 and 6. The lower looper 10 performs an oscillating movement according to arrow 13.

Figure 2:
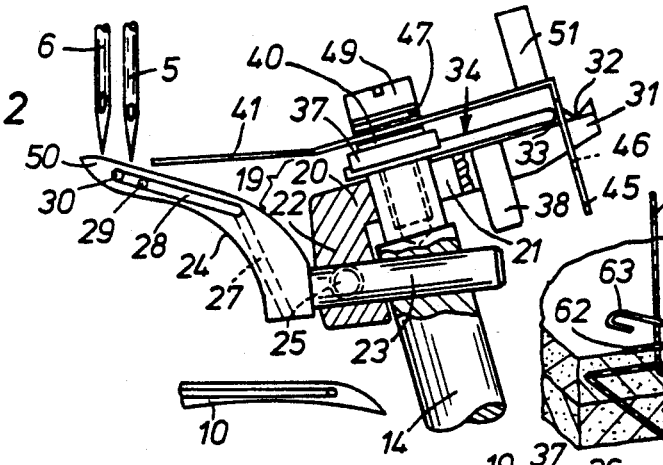
FIG. 2 is a partially sectional view showing an enlarged detail of the looper guide bar with the looper holder and two embodiments of the overcast looper and with the lower looper, which cooperates with the needles, in one position of the thread-carrying overcast looper for forming the stitch type 512 shown in FIG. 4.
Figure 5:
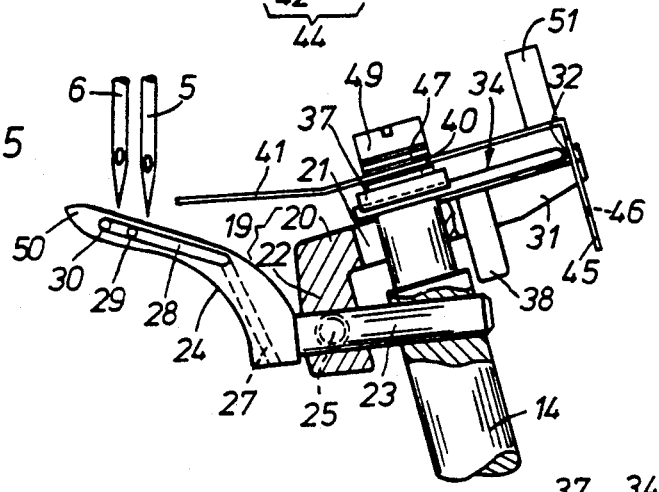
FIG. 5 is a view similar to that in FIG. 2 in a position of the overcast looper for forming the stitch type 514 shown in FIG. 7.

The overcast looper guide bar 14, which is guided longitudinally movably in a revolute and sliding joint 15, is driven by an oscillating shaft 16 via a drive lever 17, which is hinged to the lower, fork-shaped end 18 of the guide bar 14. The upper end of the guide bar 14 has a reduced diameter, as can be seen in FIGS. 2 and 5. An angular looper holder 19 has in one of its legs 20 a longitudinal slot 21 and is placed onto the narrowed end of the guide bar 14. A hole for the passage of the shaft 23 of an overcast looper 24, in which hole it is fastened with a screw 25, is provided in the downwardly extending leg 22 of the looper holder 19. The looper 24 has a thread catching shoulder 26. A hole directed obliquely relative to the longitudinal axis of the guide bar 14, in which the overcast looper 24 is guided displaceably with its shaft 23, is provided in the guide bar 14.

The overcast looper 24 has a thread hole 27 (See FIGS. 2 and 5) and a thread guiding groove 28, from which two transverse holes, which are arranged at spaced locations from each other and will hereinafter be called thread eyes 29 and 30, and whose purpose will be described later, traverse the overcast looper 24. In practice, the overcast looper 24 has only one thread eye. To show another design, it is represented with two thread eyes 29 and 30 in the drawings.

The leg 20 of the looper holder 19 has a projection 31, in which two V-shaped locking grooves 32 and 33 are provided for a spring clip 34, wherein the legs 35 and 36 of the spring clip are in contact with the front side of the guide bar 14, and the spring clip is associated with a clamping disk 37 provided on the underside with corresponding grooves for the legs 35 and 36 of the spring clip 34. The looper holder 19 is provided with a handgrip 38 for displacing the looper holder 19 from one working position of the overcast looper 24 fastened in the looper holder 19 into the other working position, which positions are determined by the spring clip 34 in conjunction with the locking grooves 32 and 33. This arrangement provides a looper holder adjustor means.

Figure 7:
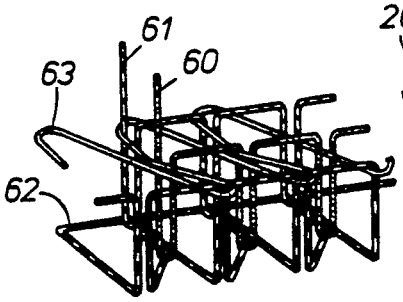
FIG. 7 is a schematic representation of stitch type 514.

Stitch type 512 (FIGS. 4 and 8), is formed in one working position of the overcast looper 24, in which the spring clip 34 snaps into the locking groove 33, due to the cooperation of the needles 5 and 6, which are movable in the direction of the arrow 8, of the lower looper 10, which is driven such that it performs oscillating movements in the direction of arrow 13, and of the overcast looper 24, which is movable in the direction of arrow 39, and stitch type 514 (FIGS. 7 and 9), is formed in the other working position of the overcast looper 24, in which the spring clip 34 snaps into the locking groove 32.

To form stitch type 502 (FIGS. 10 and 11), an overcast looper 41 made from a thin spring plate with a catching tip 44 formed by two legs 42 and 43 of unequal length is mounted by inserting a spacing plate 40. The overcast looper 41 has an angularly bent end 45 with an essentially rectangular opening 46, through which the projection 31 of the looper holder 19 extends to secure the position of the overcast looper 41.

By inserting a spring washer 47, the overcast looper 41 is fastened, together with the spring clip 34 and the clamping disk 37, to the guide bar 14 by means of a screw 49 passing through the spring washer, a longitudinal slot 48 in the overcast looper 41, the spacing plate 40, and the clamping disk 37, such that it can be displaced from a resting position into a working position, in which the leg 43 of the catching tip 44 that is farther away from the needle 5 supplements by the catching tip 50 of the overcast looper 24 by overlapping it. To facilitate handling, the overcast looper 41 is provided with a handgrip 51.

Figure 12:
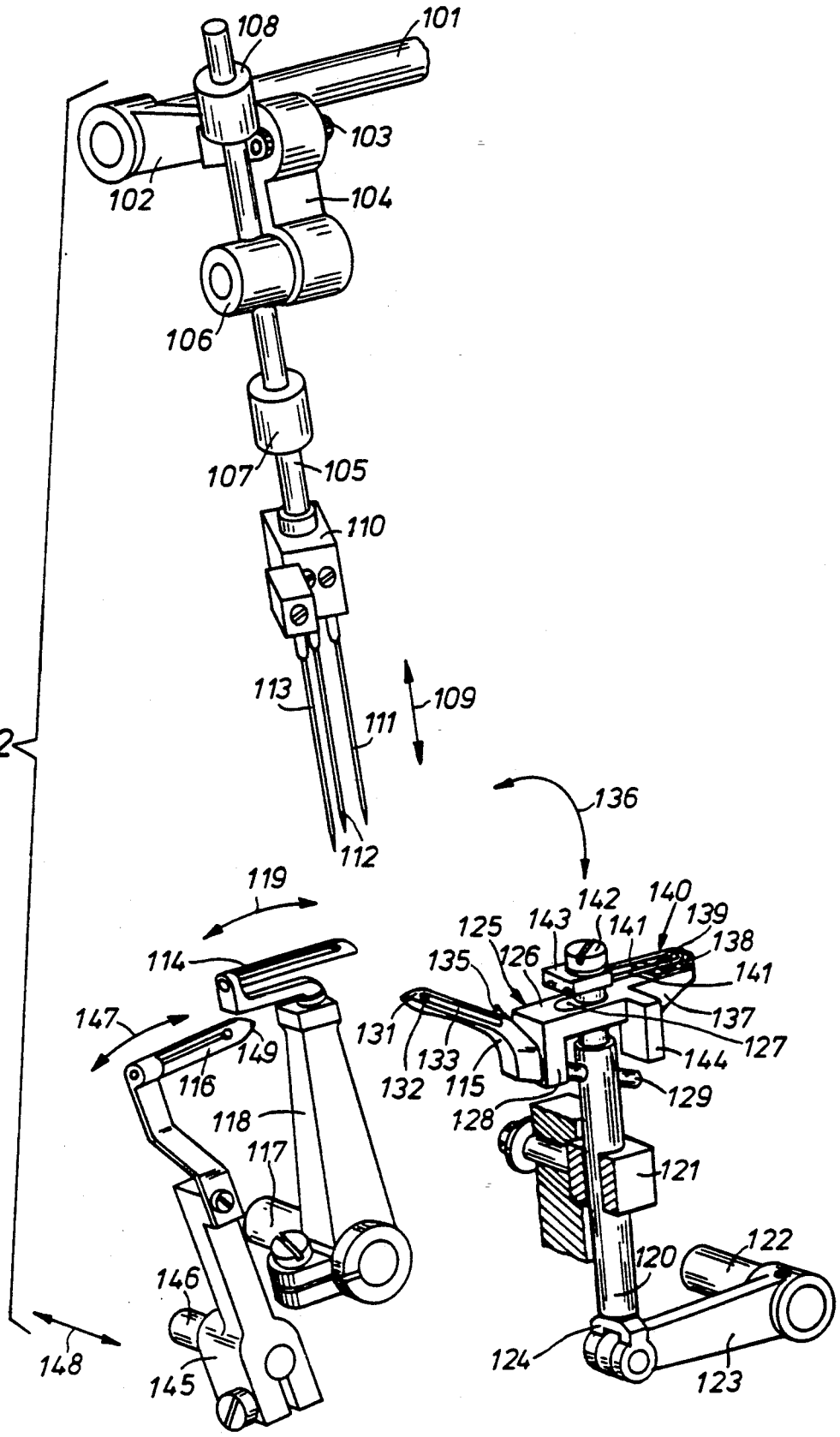
FIG. 12 is an exploded showing the stitch-forming devices with additional stitch-forming devices of an overcast sewing machine with parts of its drive mechanisms.

As is shown in FIG. 12, the needle drive lever 102, whose fork-shaped end 103 is connected by a connecting rod 104 to the needle bar pin 106 fastened to the needle bar 105, is fastened on the oscillating shaft 101. The needle bar 105 can be moved up and down in bearing bushes 107 and 108, which are permanent parts of the housing, as is indicated by arrow 109 in FIG. 12. A needle holder 110, in which three thread-carrying needles 111, 112, and 113 are inserted and fastened, is fastened at the lower end of the needle bar 105. The needle 113 is arranged laterally offset from the needles 112 and 113, which are arranged in one line extending at right angles to the direction of feed of the material to be sewn, and in front of the latter needles. A thread-carrying lower looper 114 and a thread-carrying overcast looper 115 cooperate with the needles 111 and 112, and a thread-carrying double chain stitch looper 116 cooperates with the needle 113. The lower looper 114 is fastened in a looper holder 118 clamped onto the oscillating shaft 117, and it performs an oscillating movement corresponding to arrow 119.

The overcast looper guide bar 120, which is guided longitudinally displaceably in a revolute sliding joint 121, is driven by an oscillating shaft 122 via a drive lever 123, which is hinged to the lower, fork-shaped end 124 of the guide bar 120. The upper end of the guide bar 120 has reduced diameter, as is indicated in FIGS. 12, 13, and 16. An angular looper holder 125, which has a longitudinal slot 127 in one of its legs 126, is mounted on the end of the guide bar 120. In the downwardly extending leg 128 of the looper holder 125, a hole for the passage of the shaft 129 of the overcast looper 115, in which hole the shaft is fastened with a screw 130, is provided. In the vicinity of its catching tip 131, the overcast looper 115 has a thread eye 132, which begins in a thread guide groove 133 which joins a thread feed hole 134 passing through the looper body. To support the lower looper thread taken up by the overcast looper 115, the overcast looper 115 has a thread catching shoulder 135. It performs a movement around the edge of the material to be sewn, W, corresponding to arrow 136 in FIG. 12.

The leg 126 of the overcast looper holder 125 has a projection 137, in which two V-shaped locking grooves 138 and 139 are provided for a spring clip 140, which is fastened to the guide bar 120 by inserting a clamping disk 143 having corresponding grooves on its underside for the legs 141 of the spring clip 140. A handgrip 144 for displacing the looper holder 125 from one working position of the overcast looper fastened in the looper holder 125 into another working position, which working positions are determined by the spring clip 140 in conjunction with the locking grooves 138 and 139, is provided on the looper holder 125.

The double chain stitch looper 116, which cooperates with the needle 113 to form stitch type 401, DIN 61400 (U.S. Federal Standard Catalogue No. 751), is fastened on a looper holder 145, which is clamped on an oscillating shaft 146. In addition to its oscillating movements in the direction of arrow 147 in FIG. 12, axial displacing forces in the direction of arrow 148 are also imparted to the oscillating shaft 146. The two movement components result in an elliptical movement path 150 (FIGS. 19 and 20) of the catching tip 149 of the double chain stitch looper 116 around the path of movement of the needle 113 to catch and throw off the loop 153 of the needle thread 151.

In one working position (FIGS. 13 and 14) of the overcast looper 115, in which the spring clip 140 snaps into the locking groove 139, a stitch type 512, DIN 61400, U.S. Federal Standard Catalogue No. 751, is formed due to the cooperation of the needles 111 and 112, which can be moved in the direction of the arrow 109; of the overcast looper 115, which can be moved in the direction of the arrow 136 around the edge of the material being sewn W; and of the lower looper 114, which is driven to perform an oscillating movement in the direction of the arrow 119. This is an imitation four-thread safety seam. FIGS. 15 and 19 show this seam together with the double chain stitch seam, stitch type 401.

The four-thread overcast seam stitch type 514, DIN 61400, U.S. Federal Standard Catalogue No. 651, is formed in the other working position (FIGS. 16 and 17) of the overcast looper 115, in which the spring clip 140 snaps into the locking groove 138. FIGS. 18 and 20 show this seam together with the double chain stitch seam, stitch type 401.

Mode of Operation

Figure 4:
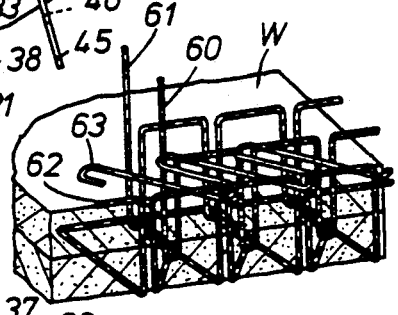
FIG. 4 is a schematic representation of stitch type 512.
Figure 3:
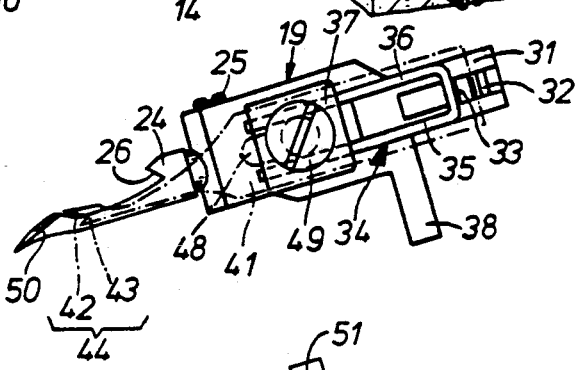
FIG. 3 is a top view of the arrangement shown in FIG. 2.
Figure 8:
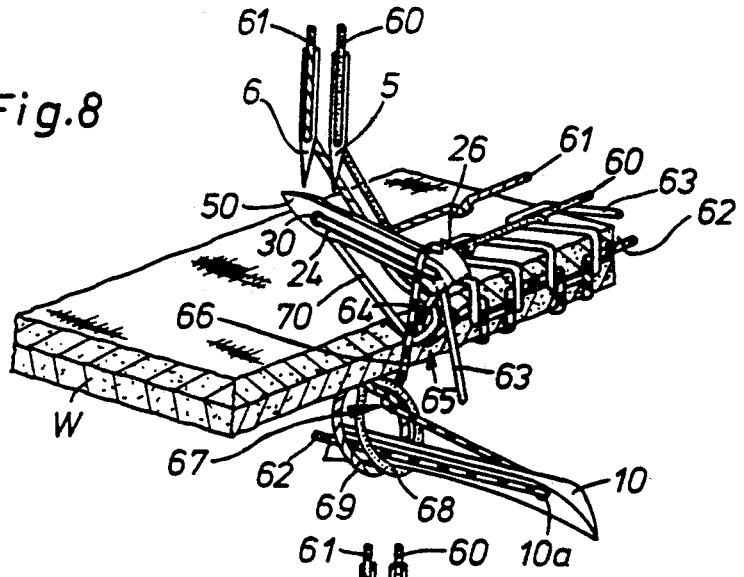
FIG. 8 is a perspective view illustrating the formation of stitch type 512.
Figure 9:
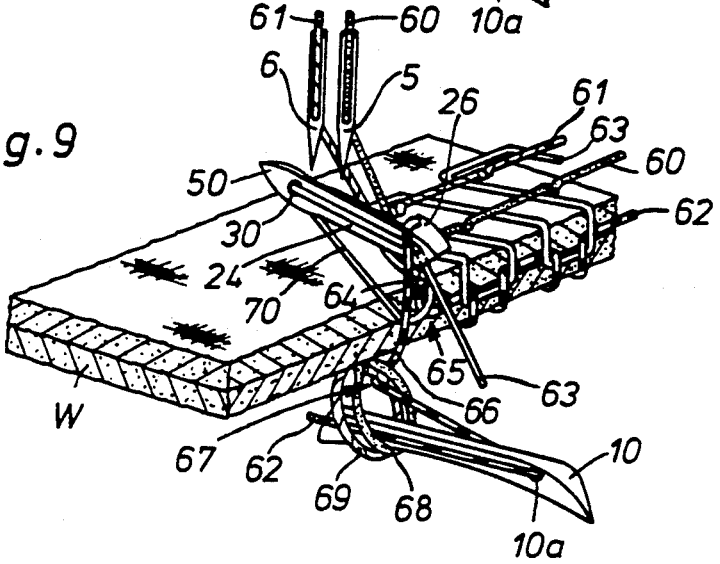
FIG. 9 is a perspective view illustrating the formation of stitch type 514.

For the stitch type 512 shown in FIG. 4, which consists of the sewing threads 60 and 61, the lower looper thread 62, and the overcast looper thread 63, and for its formation, which is illustrated in FIG. 8, the overcast looper thread 63, which, coming from a thread reserve, is fed, according to one design, through the thread hole 27 and the thread groove 28, is threaded through the thread eye 30, and the looper holder 19 is brought into its first, retracted working position shown in FIGS. 2 and 3, in which the spring clip 34 has snapped into the locking groove 33, and the thread eye 29 is located to the right of the path of movement of the needle 5 in FIGS. 2, 3 and 8, and the thread eye 30 is located to the left of the path of movement of the needle 5. Stitch formation takes place such that the lower looper 10 penetrates into the loops 68 and 69 of the needle threads 60 and 61, respectively, during the forward oscillating movement. During its upwardly and laterally directed arc-shaped movement corresponding to arrow 39,(See FIG. 1) the overcast looper 24 takes up the lower thread 62 emerging from the thread eye 10*a* of the lower looper 10 on the rear side of the lower looper 10 in FIG. 8 behind the thread eye 10*a*. This lower thread is caught by the catching shoulder 26 of the overcast looper 24, so that, as is shown in FIG. 8, it lies as a loop over the overcast looper 24, whose needle-side leg 64 extends to the interlacing 65 with the overcast looper thread 63 at the edge of the material being sewn, and whose leg 66, which is farther away from the needle, extends from the catching shoulder 26 to the interlacing 67 with the two needle thread loops 68 and 69. The part 70 of the overcast looper thread 63, which emerges from the thread eye 30 on the needle side and extends to the interlacing 67, is fed by the material feed of the needle 5 with the thread 60 such that it penetrates into the triangle formed by the leg 70 of the overcast looper thread, which leg extends from the thread eye 30 to the interlacing 65 of the lower looper thread 62 with the overcast looper thread at the edge of the material being sewn, by the needle-side leg 64 of the lower looper thread 62 lying around the overcast looper 24 in its catching shoulder 26, and by the overcast looper 24 proper, while the needle 6 with the needle thread 61 passes only through the material being sewn W. During its back-swinging movement, the lower looper 10 throws off the needle thread loops 68 and 69, which are then pulled by the thread layer, so that the lower looper thread 62 is interlinked by the needle threads 60 and 61 on the underside of the workpiece W. On the top side of the workpiece W, the overcast looper thread 63 is interlinked only with the needle thread 60.

Figure 6:
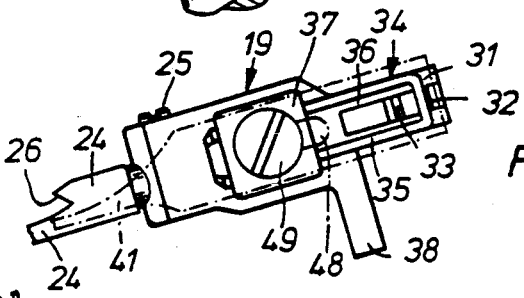
FIG. 6 is a top view of the arrangement according to FIG. 5.

To change over from stitch type 512 to stitch type 514, the looper holder 19 with the overcast looper 24 only need be pushed forward into the second working position to the needles 5 and 6 to the extent that the spring clip 34 will snap into the locking groove 32. In this second working position (FIGS. 5, 6 and 9), the path of movement of the needles 5 and 6 is to the right of the thread eye 30. After the lower looper 10 has penetrated into the needle thread loops 68 and 69, after the lower looper thread 62 carried by the lower looper has been taken up by the overcast looper 24 on the needle side behind the thread eye 10*a*, and after the overcast looper thread leg 70 emerging from the thread eye 30 of the overcast looper 24 on the needle side has been fed to the needles 5 and 6, both of the needles 5 and 6 with the threads 60 and 61 penetrate into the triangle formed by the leg 70 of the overcast looper thread 63, by the leg 64 of the lower looper thread 62, and by the overcast looper 24, and pass through the material being sewn W. The overcast looper thread 63 is now interlinked with the two needle threads 60 and 61 on the top side of the material being sewn, and on the underside of the material being sewn, the lower looper thread 62 interlaced with the overcast looper thread 63 at the edge of the material being sewn is also interlinked with both of the needle threads 60 and 61 by throwing off the two needle thread loops 68 and 69 caught by the lower looper thread, which are pulled by the thread layers to the underside of the material being sewn.

As in the state of the art, stitch type 504 can be formed by removing the right-hand needle 5 with the looper holder 19 of the overcast looper 24 in the second working position or by omitting the left-hand needle 6 with the looper holder 19 and with the overcast looper 24 in the first working position.

According to the other design, stitch type 512 (FIG. 4) is formed by leaving the overcast looper 41 with the catching tip 44 in its resting position and fixing the looper holder 19 with the overcast looper 24 in its second working position displaced toward the needles 5 and 6 (FIGS. 5 and 6), in which the spring clip 34 has snapped into the locking groove 32. The overcast looper thread 63, fed in through the thread hole 27 and the thread groove 28, is threaded through the thread eye 29, which is located to the left of the path of movement of the needle 5 and to the right of that of the needle 6 in FIG. 5.

After the lower looper 10 has penetrated into the loops 68 and 69 of the needle threads 60 and 61 at the beginning of the upward movement of the inserted needles 5 and 6, after the lower thread 62 carried by it has been taken up by the overcast looper 24 on the needle side behind the thread eye 10*a*, and after the leg 70 emerging on the needle side from the thread eye 29 of the overcast looper 24 has been brought to the feed position over the material being sewn W, only the needle 5 with the needle thread 60 penetrates into the triangle formed during the feed of the material being sewn by the leg 70 of the overcast looper thread 63, by the leg 64 of the lower looper thread 62, and by the overcast looper 24, whereas the needle 6 with the needle thread 61 penetrates only the material being sewn W, as a result of which the overcast looper thread 63 is interlinked with the needle thread 60 on the underside of the material being sewn, and the lower looper thread 62, which is interlaced with the overcast looper thread 63 at the edge of the material being sewn, is interlinked with both of the needle threads 60 and 61 on the underside of the material being sewn due to the needle thread loops 68 and 69 being thrown off during the swing-back movement off the lower looper 10 and to the loops 68 and 69 being tensioned by the thread layer of the sewing machine.

To sew stitch type 514 (FIG. 7), only the overcast looper thread 63 needs be pulled out of the thread eye 29 and be threaded through the thread eye 30, without changing the position of the looper holder 19 with the overcast looper 24 and the overcast looper 41. The paths of movement of both of the needles 5 and 6 are now to the right of the thread eye 30 in FIG. 5. After the loopers 10 and 24 have reached the above-mentioned "feed position", both of the needles 5 and 6 penetrate into the triangle formed during the feed of the material being sewn by the leg 70 of the overcast looper thread 63, the leg 64 of the lower looper thread 62, and the overcast looper 24, so that both threads, namely, the overcast looper thread 63 on the top side of the material being sewn and, on the underside of the material being sewn, the lower looper thread 62 interlaced with the overcast looper thread 63 at the edge of the material being sewn, are interlinked with the needle threads 60 and 61 after the needle thread loops 68 and 69 have been thrown off during the back-swinging movement of the lower looper 10 and pulled by the thread layer of the sewing machine toward the material being sewn.

After removal of one needle, stitch type 504 can be formed with the second design as well.

Figure 10:
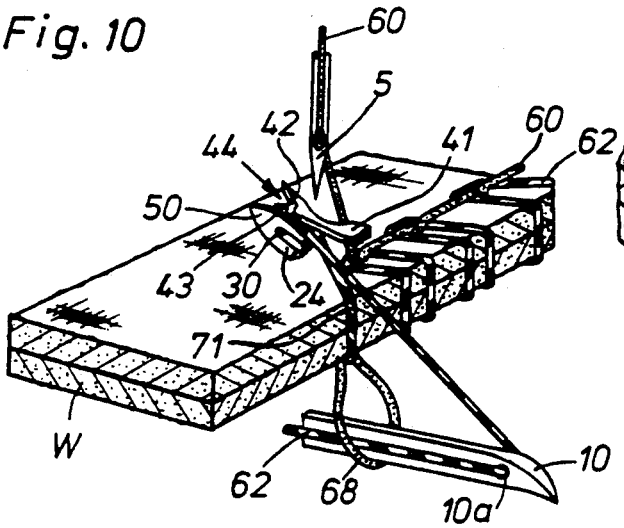
FIG. 10 is a perspective view illustrating the formation of stitch type 502, in which the overcast looper with the fork-shaped catching tip is shown in its working position.
Figure 11:
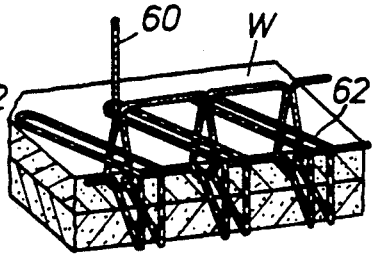
FIG. 11 is a schematic representation of stitch type 502.

To form stitch type 502 (FIGS. 10 and 11), one needle, e.g., needle 6, is removed, the overcast looper thread 63 is pulled out of the thread eye 30, the looper holder 19 with the overcast looper 24 is brought into its working position farther away from the needle 5, in which position the spring clip 34 has snapped into the locking groove 33, and the overcast looper 41 is pushed toward the tip 50 of the overcast looper 24 into a working position, in which the fork leg 43 of the catching tip 44 covers part of the looper tip 50, and this the looper tip forms an extension of the fork leg 43, as is shown in FIG. 10.

Stitch formation is now performed such that the lower looper 10 with the lower looper thread 62 penetrates into the needle thread loop 68 formed at the beginning of the upward movement of the inserted needle 5, the fork-shaped catching tip 44 of the looper 41 catches, together with the catching tip 50 of the overcast looper 24, the lower looper thread 62 emerging from the needle lug 10*a* on the needle side to the left of the thread eye 10*a* in FIG. 10, and feeds it around the edge of the material being sewn over the workpiece W in front of the needle 5. The needle 5 with the needle thread 60 then penetrates between the leg 71 of the lower looper thread 62 extending between the bottom of the catching tip 44 to the needle thread loop 68 and the overcast looper 41. During the return of the overcast looper 41 and of the lower looper 10, the lower looper thread 62 is released by the catching tip 44 and is brought by the lower looper 10 to the underside of the workpiece around the edge of the material being sewn, and the loop 68 of the needle thread 60 is thrown off and pulled by the thread layer of the sewing machine to the underside of the material being sewn. The lower looper thread 62 is thus interlinked with the needle thread 60 on the top side of the material being sewn and on the underside of the material being sewn.

To form the double chain stitch seam 401, stitch type 401 according to DIN 61400, U.S. Federal Standard Catalogue No. 751, which consists of the needle thread 151 and the looper thread 152, the needle 131 carrying the needle thread 151 is inserted into the triangle that is formed by the loop 153 of the needle thread 151, which loop is caught by the double chain stitch looper 116 during the forward oscillation and lies around it, by the leg 152*a* of the looper thread 152 extending to the stitch hole in front of the thread eye 116*a*, and by the double chain stitch looper 116. During the back-swinging of the double chain stitch looper 16, the loop 153 is thrown off and pulled by the known thread layer toward the underside of the material being sewn.

To form the imitation safety seam shown in FIGS. 15 and 19, stitch type 512 according to DIN 61400, U.S. Federal Standard Catalogue No. 751, which consists of the needle threads 154 and 155, the lower looper thread 156, and the overcast looper thread 157, the looper holder 125 with the overcast looper 115 carrying the overcast looper thread 157 is brought into the first working position shown in FIGS. 13 and 14, in which the spring clip 140 snaps into the locking groove 139, and the thread eye 132 of the overcast looper 115 is located between the paths of movement of the two needles 111 and 112 as shown in FIGS. 13 and 14 "when the needle 154 enters into the triangle formed by the leg 164 of the overcast looper thread 157, the needle side of the overcast looper 115 and the interlacing of said lower looper thread 156 with said overcast looper thread 157 at the edge of the material being sewn". Stitch formation is performed such that the lower looper 114 penetrates into the loops 158 and 159 of the needle threads 154 and 155 during the forward oscillating movement. During its upwardly and laterally directed arc-shaped movement according to the arrow 136 (FIG. 12), the overcast looper 115 takes up the lower looper thread 156 emerging from the thread eye 114*a* on the rear side of the lower looper 114 behind the thread eye 114*a*. This lower looper thread is caught by the catching shoulder 135 of the overcast looper 115, so that it lies, as is shown in FIG. 19, over the overcast looper 115 as a loop, whose needle-side leg 160 extends to the interlacing 161 formed with the overcast looper thread 157 at the edge of the material being sewn, and whose leg 162 away from the needle extends from the catching shoulder 135 to the thread eye 114*a* through the interlacing 163 formed with the two needle thread loops 158 and 159. The part 164 of the overcast looper thread 157, which emerges from the thread eye 132 on the needle side and extends to the interlacing 161, is introduced by the material feed of the needle 111 into the triangle formed by the leg 164 of the overcast looper thread 157, which extends from the thread eye 132 to the interlacing of the lower looper thread 156 with the overcast looper thread 157 at the edge of the material being sewn, by the needle-side leg 160 of the lower looper thread 156 lying around the overcast looper 115 in its catching shoulder 135, and by the overcast looper 115 proper, while the needle 112 with the needle thread 155 penetrates only through the material being sewn W. During its back-swinging movement, the lower looper 114 throws off the needle thread loops 158 and 159, which are then tensioned by the known thread layer, so that the lower looper thread 156 is interlinked by the needle threads 154 and 155 on the underside of the material being sewn. On the top side of the material being sewn, the overcast looper thread 157 is interlinked only with the needle thread 154.

To change over from stitch type 512 to stitch type 514, the looper holder 125 with the overcast looper 115 only needs to be pushed forward into the second working position toward the needles 111 and 112 to the extent that the spring clip 140 will snap into the locking groove 138. In the second working position (FIGS. 16, 17 and 20), the path of movement of the needles 111 and 112 are located to the right of the needle eye 132. After the lower looper 114 has penetrated into the needle thread loops 158 and 159, after the lower looper thread 156 carried by it has been taken up by the overcast looper 115 on the needle side behind the thread eye 114*a*, and after the overcast looper thread leg 164 emerging on the needle side from the thread eye 132 of the overcast looper 115 has been fed to the needles 111 and 112, both of the needles 111 and 112 with the threads 154 and 155 penetrate into the triangle formed by the leg 160 of the lower looper thread 156 and the overcast looper 115 during the feed of the material being sewn, and pass through the material being sewn W. The overcast looper thread 157 on the top side of the material being sewn is interlinked with both of the needle threads 154 and 155, and the lower looper thread 156, interlaced with the overcast looper thread 157 at the edge of the material being sewn, is also interlaced with both of the sewing threads 154 and 155 on the underside of the material being sewn by the two needle thread loops 158 and 159, which are caught by the lower looper thread and pulled by the thread layer to the underside of the material being sewn.

Stitch type 504 (FIG. 21) is formed by removing the needle 111 with the looper holder 125 of the overcast looper 115 in the second working position or by omitting the left-hand needle 112 with the looper holder 125 and the overcast looper 115 in the first working position.

While specific embodiments of the invention have been shown and described in detail to illustrate the application of the principles of the invention, it will be understood that the invention may be embodied otherwise without departing from such principles.

We claim:

1. An overcast sewing machine for forming multiple-thread overcast seams, comprising:

at least two-thread carrying needles positioned at spaced locations from each other;

a thread-carrying lower looper for taking up and throwing off needle thread loops;

a thread-carrying overcast looper mounted on an overcast looper holder for taking up the needle thread loops and laying an overcast looper thread around an edge of a material being sewn and feeding the overcast looper thread into a position allowing penetration of at least one of the needles into a thread triangle formed by a leg of the overcast looper thread extending from an overcast looper thread eye to an interlacing of the lower looper thread with the overcast looper thread at the edge of the material being sewn, a needle-side leg of the lower loop thread lying around the overcast looper, said overcast looper holder being associated with adjustor means for securely holding said overcast looper holder with said overcast looper mounted thereon in a first working position, in which both needles penetrate into said thread triangle, and being displaceable into and adjusted in a second working position, in which only the needle adjacent to the edge of the material being sewn penetrates into said thread triangle.

2. An overcast sewing machine according to claim 1, wherein said overcast looper includes a shaft displacebly received in a transverse hole of a guide bar and fastened in the overcast looper holder, said overcast looper holder displaceably guided at a free end of said guide bar and together with said overcast looper and its shaft being displaceable between said first and second working positions and fixable at a location between said first and second working positions by said adjustor means.

3. An overcast sewing machine according to claim 2, wherein said adjustor means includes two locking grooves and a spring clip, said locking grooves being provided on said overcast looper holder and said spring clip being fastened to said guide bar.

4. An overcast sewing machine according to claim 2 wherein said overcast looper holder includes a hand grip.

5. An overcast sewing machine according to claim 1, for forming a two-thread overcast seam with only a single needles, which single needle is adjacent to said material, carrying thread, in which said overcast looper carries no thread, said overcast looper in a first position being overlaid with a fork-shaped catching tip of an additional overcast looper formed by two legs of unequal length, a tip of said overcast looper being supplemented by one of said legs, said one of said legs is farther away from said single needle, said one of said legs being displaced on said overcast looper holder into and fixed in a working position in which one of said looper legs catches the lower loop thread together with the tip of the overcast looper, leads the lower looper thread around the edge of the material to be sewn, and feeds the lower looper thread allowing penetration of said single needle between the overcast looper and one of said legs of the lower looper thread which is extending from the fork-shaped catching tip to the edge of the material to be sewn.

6. An overcast sewing machine according to claim 5, wherein said fork-shaped looper includes an angularly bent end with an essentially rectangular opening, through which a projection of said overcast looper holder extends for securing said fork-shaped looper in said first and working positions.

7. An overcast sewing machine according to claim 6, wherein said fork-shaped looper includes a hand grip.

8. An overcast sewing machine according to claim 1, wherein said at least two-thread carrying needles are movable in a reciprocating manner, said thread carrying overcast looper is swingingly driven adjacent to the edge of the material being sewn and said thread forming means for forming overcast seams comprising stitch type numbers 504 or 512 or 514, additional stitch-forming means, carrying lower looper is swingingly driven below the material being sewn to define stitch material being sewn being provided for performing a double chain stitch seam comprising stitch type number 401 to the side of the including one needle and a thread carrying looper driven in an elliptical path below the respective overcast seam stitch types number 504, 512, 514.

9. An overcast sewing machine according to claim 8, wherein said additional stitch-forming means are positioned in front of the stitch-forming means for forming the overcast seams.

10. An overcast sewing machine according to claim 1, wherein said at least two thread carrying needles are movable in a reciprocating manner, said thread carrying overcast looper is swingably driven adjacent to the edge of the material being sewn and said thread carrying lower looper is swingingly driven below the material being sewn to define stitch forming means for forming:

(a) a three-thread overcast seam, stitch type number 504, DIN 61400, U.S. Federal Standard Catalogue Number 751, (b) an imitation four-thread overcast seam, stitch type number 514 DIN 61400, U.S. Federal Standard Catalogue Number 751, and (c) a four-thread overcast seam, stitch type number 514 DIN 61400, U.S. Federal Standard Catalogue Number 751, and additional stitch forming means being provided including one needle and a thread carrying looper driven in an elliptical path below the material being sewn for performing a double chain stitch type number 401; and activation means for activating said stitch forming means and additional stitch forming means in combination and for activating said additional stitch forming means alone.

11. An overcast sewing machine for forming multiple-thread overcast seams, comprising: at least two thread-carrying needles position at spaced locations from each other; a thread-carrying lower looper for taking up and throwing off needle thread loops; a thread-carrying overcast looper provided with a tip for taking up a looper thread led through the needle thread loops and laying an overcast looper thread around an edge of the material being sewn and feeding said overcast looper thread to a point of penetration of the needles into a thread triangle formed by a leg of said overcast looper thread extending from a thread eye of the overcast looper to an interlacing of said lower looper thread with the overcast looper thread at the edge of the material being sewn, by said needle-side leg of the lower looper thread lying around the overcast looper, and by the overcast looper, said overcast looper including two thread eyes located at spaced locations from said tip at a distance between said eyes corresponding to a distance between said two thread carrying needles, said overcast looper thread being optionally fed through said thread eyes to form one of two different overcast seams, one being stitch type 512 where only one needle penetrates into said thread triangle when the overcast looper thread is led through the thread eye located at a greater distance from the tip of said overcast looper and the other being stitch type 514 where both of said needles penetrate into said thread triangle when the overcast looper thread is led through the other thread eye located at a small distance from said tip.

* * * * *